US012201233B2

(12) United States Patent
Harrington

(10) Patent No.: US 12,201,233 B2
(45) Date of Patent: Jan. 21, 2025

(54) INTERCHANGEABLE HANGER MOUNTING SYSTEM

(71) Applicant: David W. Harrington, Plymouth, MA (US)

(72) Inventor: David W. Harrington, Plymouth, MA (US)

( * ) Notice: Subject to any disclaimer, the term of this patent is extended or adjusted under 35 U.S.C. 154(b) by 0 days.

(21) Appl. No.: 18/517,545

(22) Filed: Nov. 22, 2023

(65) Prior Publication Data

US 2024/0164552 A1 May 23, 2024

Related U.S. Application Data

(60) Provisional application No. 63/427,690, filed on Nov. 23, 2022.

(51) Int. Cl.

| | |
|---|---|
| ***A47G 7/04*** | (2006.01) |
| ***A47F 5/08*** | (2006.01) |
| *A47F 7/00* | (2006.01) |

(52) U.S. Cl.

CPC ..... *A47G 7/044* (2013.01); *A47F 5/08* (2013.01); *A47F 5/0838* (2013.01); *A47F 5/0846* (2013.01); *A47F 7/00* (2013.01)

(58) Field of Classification Search

CPC .. A47G 7/044; A47G 7/00; A47G 7/04; A47F 7/0078; A47F 5/0846; A47F 5/08; A47F 5/0807; A47F 5/0838; A47F 5/0876; A47F 7/00

See application file for complete search history.

(56) References Cited

U.S. PATENT DOCUMENTS

| | | | | | |
|---|---|---|---|---|---|
| 741,619 | A | * | 10/1903 | Bowles | B62C 9/00 54/61 |
| 918,039 | A | * | 4/1909 | Groundmann | A47B 57/402 211/183 |
| 3,465,924 | A | * | 9/1969 | Michaels | A47K 5/10 222/561 |
| 3,848,844 | A | * | 11/1974 | Barrett | A47B 57/56 108/106 |
| 4,156,515 | A | * | 5/1979 | Mochly | A47B 57/567 248/246 |
| 4,212,445 | A | * | 7/1980 | Hagen | A47B 88/43 248/245 |
| 4,314,646 | A | | 2/1982 | Purnell | |
| 4,340,199 | A | | 7/1982 | Brock | |
| 4,389,133 | A | * | 6/1983 | Oberst | F16B 5/01 403/201 |

(Continued)

*Primary Examiner* — Devin K Barnett

(74) *Attorney, Agent, or Firm* — Dunlap Bennett & Ludwig, PLLC; Anna L. Kinney

(57) ABSTRACT

A hanger assembly includes a first decorative element and a mounting base. The decorative element has a first surface and a first elongated mounting plate joined thereto in a plane perpendicular to the first surface. The base has a rear surface fastenable to a vertical surface, a first sidewall, and a front surface within which is formed a recessed slot having a substantially T-shaped cross-section. The recessed slot extends from an open end in the first sidewall to a fixed stop formed in the mounting base and slidably receives the mounting plate. The mounting base may be used with a variety of interchangeable multi-themed decorations or plant hangers.

7 Claims, 5 Drawing Sheets

(56) References Cited

U.S. PATENT DOCUMENTS 4,787,595 A * 11/1988 Hegarty ..... B42F 13/402 248/458
4,828,133 A * 5/1989 Hougendobler ... B65D 5/48024 220/533
5,044,594 A * 9/1991 Hegarty ..... A47B 19/10 248/458
5,080,238 A * 1/1992 Hochman ..... A47F 5/0869 211/106.01
D329,192 S * 9/1992 Susac ..... D8/349
5,318,264 A * 6/1994 Meiste ..... A47B 57/56 52/36.5
5,356,038 A * 10/1994 Banks ..... B65D 35/40 222/105
5,356,104 A * 10/1994 Rosenberg ..... A47F 5/0846 248/225.11
5,395,080 A 3/1995 Smith
5,398,823 A * 3/1995 Anders ..... B25H 3/003 248/309.2
5,645,177 A * 7/1997 Lin ..... B25H 3/04 211/69.5
5,862,925 A 1/1999 Grzywinski
5,915,572 A * 6/1999 Hancock ..... A47B 81/005 248/222.12
6,027,083 A 2/2000 Chang
6,105,794 A * 8/2000 Bauer ..... A47B 96/063 211/208
6,488,151 B2 * 12/2002 Ramsey ..... B25H 3/06 206/378
6,527,565 B1 * 3/2003 Johns ..... H01R 25/142 362/418
6,547,086 B1 * 4/2003 Harvey ..... A47F 5/0846 211/94.01
6,591,996 B1 * 7/2003 Wu ..... A47B 96/067 211/187
6,637,707 B1 * 10/2003 Gates ..... A47B 96/061 248/222.12
D484,778 S * 1/2004 French ..... D8/373
6,827,320 B2 * 12/2004 Yeh ..... A47B 57/565 248/245
6,945,414 B1 9/2005 Stevens et al.
7,172,164 B2 * 2/2007 Fuelling ..... A01K 97/10 248/314
D549,564 S * 8/2007 Lucht ..... D8/381
7,770,743 B1 8/2010 Janowak et al.
7,832,570 B1 * 11/2010 Reynolds ..... A47B 96/14 211/187
8,371,473 B2 2/2013 Scribner et al.
8,978,300 B2 3/2015 Keats
9,060,467 B2 * 6/2015 Nee ..... A47G 7/045
9,107,518 B2 8/2015 Schilling et al.
9,226,456 B2 1/2016 Nelson et al.
D818,801 S * 5/2018 Ng ..... D8/354
10,016,077 B1 * 7/2018 Carney ..... A47G 7/044
10,330,256 B2 * 6/2019 Eckhart ..... B25H 3/00
10,709,238 B1 * 7/2020 Thompson ..... A47B 96/066
11,191,373 B2 * 12/2021 Ng ..... A47G 1/1606
D949,672 S * 4/2022 French ..... D8/373
2006/0180561 A1 * 8/2006 Wisnoski ..... A47F 5/0846 211/94.01
2006/0186304 A1 * 8/2006 McGee ..... A47G 1/1606 248/476
2006/0277824 A1 12/2006 Clair
2008/0209698 A1 * 9/2008 Colorado ..... A45F 5/02 24/595.1
2008/0302744 A1 * 12/2008 Rosenberg ..... A47F 5/0025 211/94.01
2011/0219687 A1 * 9/2011 Keats ..... A01G 9/023 47/65.6
2012/0043444 A1 2/2012 Kingery
2012/0144654 A1 6/2012 Christian et al.
2013/0186847 A1 * 7/2013 Kramer ..... A47B 81/005 211/134
2015/0068990 A1 * 3/2015 Shea ..... A47F 5/0815 211/106
2016/0338489 A1 * 11/2016 Kahle ..... A47B 81/005
2018/0110332 A1 * 4/2018 Nye ..... A47B 57/583

* cited by examiner

INTERCHANGEABLE HANGER MOUNTING SYSTEM

CROSS-REFERENCE TO RELATED APPLICATION

This application claims the benefit of priority of U.S. provisional application No. 63/427,690, filed Nov. 23, 2022, the contents of which are herein incorporated by reference.

BACKGROUND OF THE INVENTION

The present invention relates to plant hangers and decorations mounted onto an existing structure and, more particularly, to an interchangeable hanger mounting system.

People enjoy expressing themselves through decorating their homes with various things like flags, flowers, and other pieces of artwork. Plant hangers typically mount via screws or other fasteners to existing structures and are semi-permanent. Only one hanger design motif may be mounted at a time, limiting the user's creative expression. Changing a hanger requires complete dismounting, redrilling, and remounting, including changing or adding additional hardware. This is tedious and time consuming and can cause significant damage at the mounting location on any structure.

As can be seen, there is a need for a means of interchanging plant hangers or decorations at a single mounting location quickly, easily, and without causing any damage to the supporting structure.

SUMMARY OF THE INVENTION

In one aspect of the present invention, a hanger assembly comprises a first decorative element having a first surface formed in a first plane and a first elongated mounting plate joined thereto in a second plane perpendicular to the first plane; and a mounting base having a rear surface fastenable to a vertical surface, a first sidewall, and a front surface within which is formed a recessed slot having a substantially T-shaped cross-section, said recessed slot extending from an open end in the first sidewall to a fixed stop formed in the mounting base and said recessed slot being operative to slidably accommodate the first elongated mounting plate.

The Plant Hanger Clever Mount described herein is a component of an interchangeable multi-themed decoration or plant hanger system.

These and other features, aspects and advantages of the present invention will become better understood with reference to the following drawings, description, and claims.

DETAILED DESCRIPTION OF THE INVENTION

Figure 1:
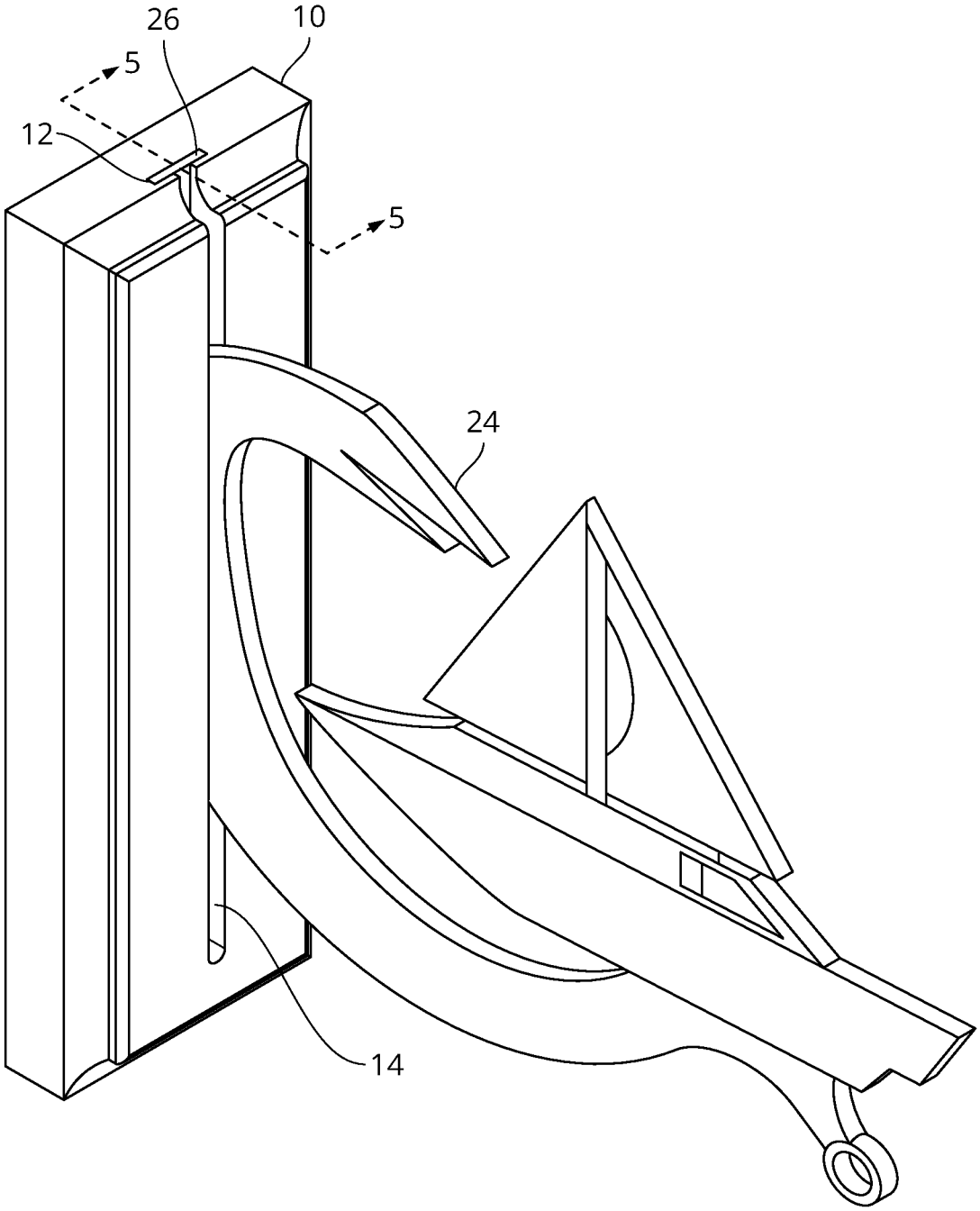
FIG. 1 is a perspective view of a mounting base according to an embodiment of the present invention, shown in use.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is an interchangeable hanger system with a mounting base and a plurality of hangers, such as plant hangers or decorations, that enables quick and easy interchange of the hanger designs.

The system is sometimes referred to herein as an "interchangeable hanger system" or 'interchangeable plant hanger system'. The mounting base is sometimes referred to herein as the "clever-mount" and is alternately referred to herein as a base or a bracket.

This first of its kind system comprises a hanger configured to mate with the 'clever-mount' base and enables a wide variety of different plant hangers to be mounted in the same spot on any structure. The 'Clever mount' base may be installed on the existing structure one time and may be used in conjunction with a variety of plant hanger design motifs configured to fit the clever mount. A plant hanger may be exchanged for another simply by sliding the old one out of the base and sliding the new one in, adding versatility and personal expression to the hanging of plants. The hangers and the 'Clever Mount' base work in concert, allowing the owner to shuffle, interchange, and reconfigure the display according to their personal preferences. This system separates the mounting from the hanger itself, allowing for quick and easy interchange of a wide variety of hanger designs WITHOUT tools. Additionally, being able to easily 'swap out' hangers eliminates the structural damage caused by dismounting the old hanger and remounting the new hanger. No additional drilling or mounting are required.

The Clever mount base may be, e.g., about ¼" and may be painted with enamel exterior semi-gloss. The base may be manufactured from polyvinyl chloride (PVC), for example. A sliding slot is cut into the base, e.g., with a 1⅛"×5⁄16"×⅜" T-slot bit and is sized to accommodate the hangers sliding in and out. The clever mount also generally enables water drainage to further protect both the mount and the hanger from corrosion and weathering. The base may have a 3'16" drainage hole. The 'Clever Mount' base may have ¼" countersunk mounting holes and may be attached to an existing structure (e.g., a wall or post), using 2" exterior grade mounting screws.

In some embodiments, the 'Clever mount' base may be utilized to mount other decorative or useful devices without the need of permanent mounting, provided the device has a structural component that fits into the base slot.

The Plant hangers are manufactured and configured to fit easily and securely into the 'Clever Mount' base. This affords the owner of the product the ability to change hangers without the use of any additional hardware or hand work, simply by sliding them in and out of the base. These units offer individual expression according to personal interests, hobbies and geographic locations that are customizable, e.g., by the placement of a magnetic marker. The number of hangers contained in the system is not particularly limited. In an example, 54 distinct hangers may be interchangeably mountable to the base.

The hangers may be manufactured, e.g., of durable strong 12 Gauge steel and powder coated to protect from corrosion and weathering. Each of the plant hanger designs may have a mounting bar, e.g., about ¼" thick, configured to slide into the PVC 'clever mount' bracket. The edge of the mount slide may be made with 5⁄32" decorative molding having a Roman Ogee profile.

When purchasing one or several of the custom-designed plant hangers, the customer may be offered one or more of the 'clever mount' bases as a part of the purchase. Using this system, additional hangers can be added and displayed in the same location using the same mounting hardware. This eliminates the need to measure, drill, and mount any additional hangers. Together these components allow for quick and easy interchangeability and wider expression of an individual's personal tastes, interests, and creativity.

To use the system disclosed herein, the user installs the 'Clever-Mount' bracket on a structure. The user slides a hanger into the clever mount and may slide the hanger out to interchange hangers quickly and easily without having to use tools or re-drill/remount to the existing wall or structure. No additional hardware is necessary.

Referring to FIGS. 1 through 5, FIG. 1 illustrates a system according to an embodiment of the present invention comprising a mounting base 10 with a hanging object 24 mounted thereto. The mounting base 10 has a T-slot or C-channel formed therein with a wide portion 12 at a first end of the base 10 tapering to a narrow portion 14 at a fixed stop. The hanging object 24 may be decorative as well as operative to hold a hanging plant (not shown).

Figure 2:
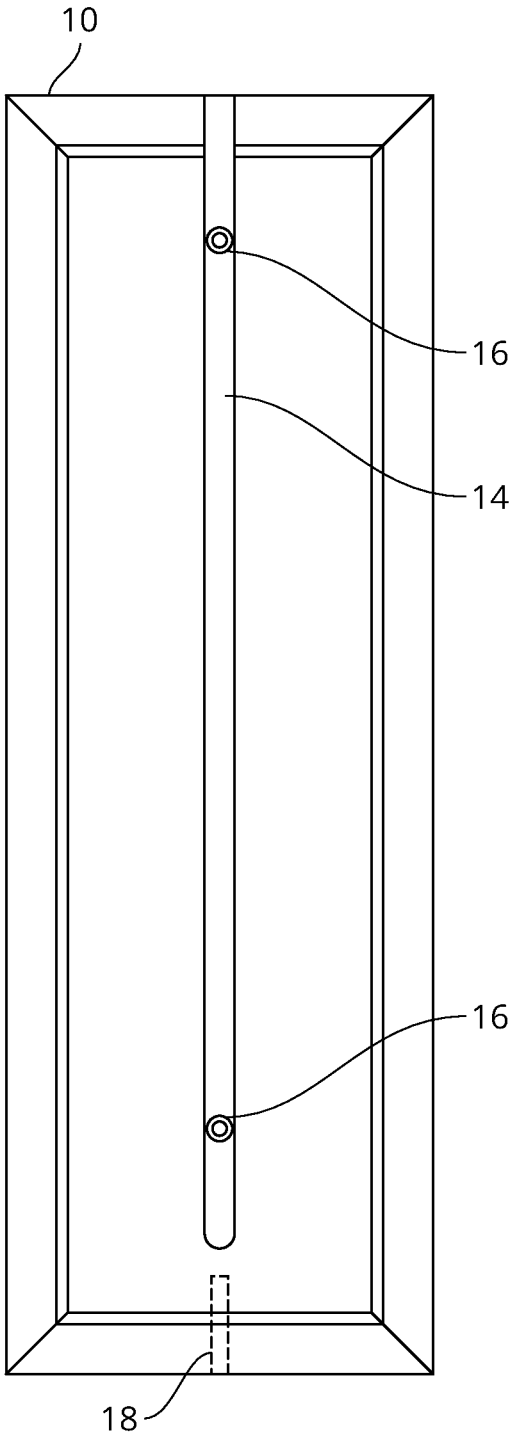
FIG. 2 is a front elevation view thereof.
Figure 3:
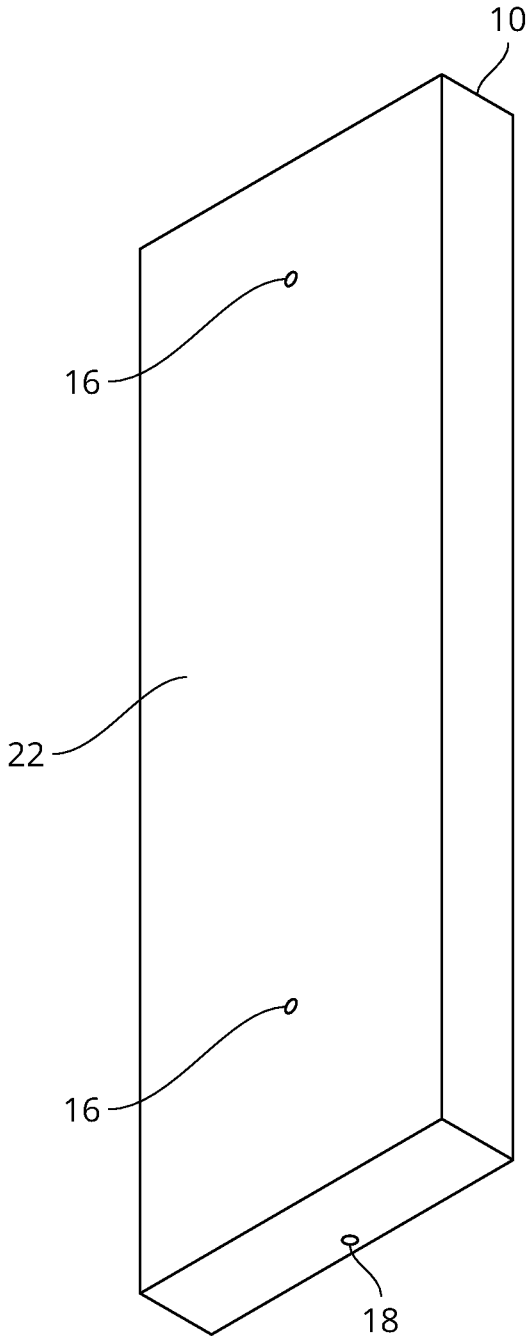
FIG. 3 is a bottom rear perspective view thereof.
Figure 5:
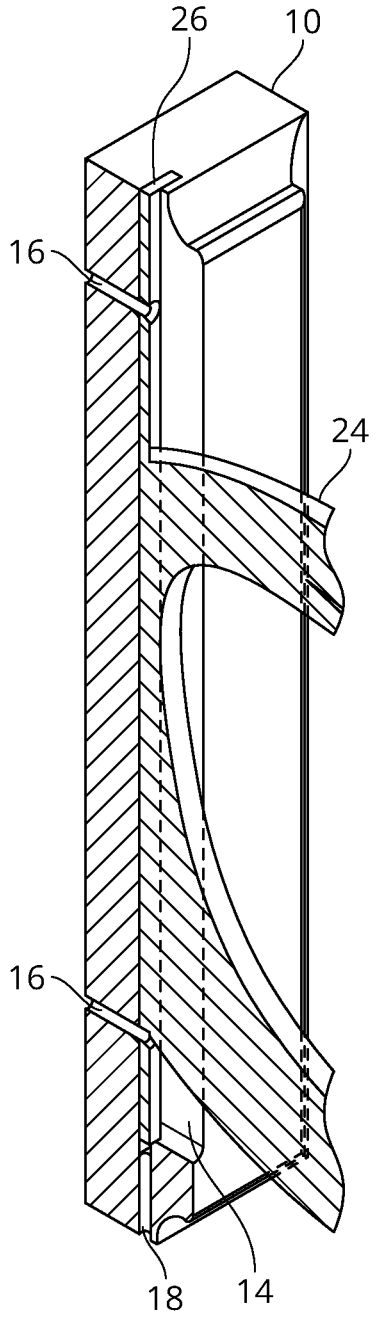
FIG. 5 is a sectional view thereof, taken along line 5-5 in FIG. 1.

As shown in FIGS. 2, 3, and 5, a drain hole 18 extends from a location adjacent to the T-slot to a second end of the base 10. Screw holes 16 formed in the base 10 extend perpendicularly from the T-slot to a planar mounting surface 22.

Figure 4:
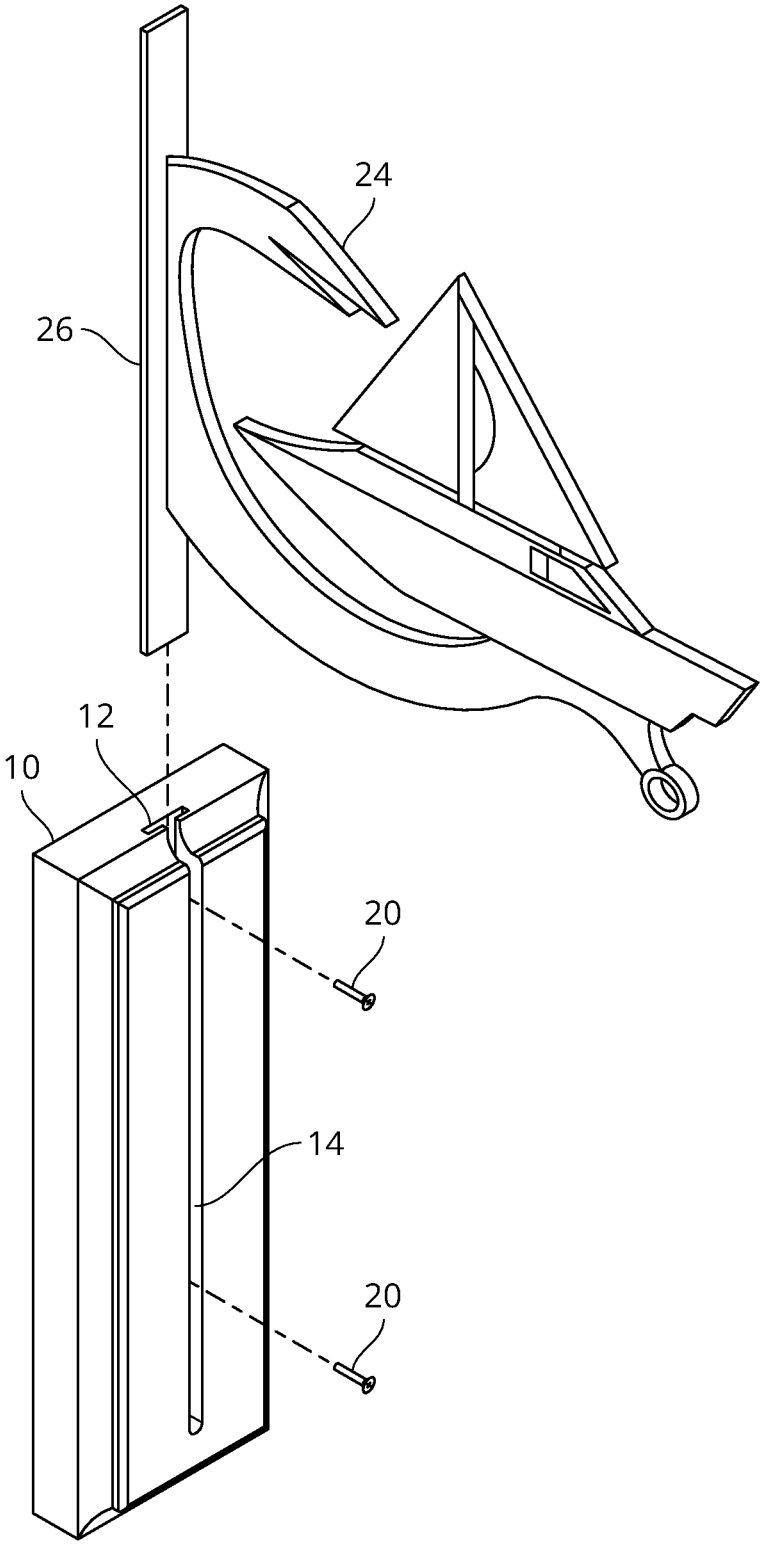
FIG. 4 is an exploded view thereof.

As shown in FIGS. 4 and 5, the hanging object 24 has a back plate 26 which conforms to the T-slot. The base 10 may be fastened to a structure such as a wall with screws 20 inserted through the screw holes 16, such that the T-slot is vertical with its open end facing upward.

It should be understood, of course, that the foregoing relates to exemplary embodiments of the invention and that modifications may be made without departing from the spirit and scope of the invention as set forth in the following claims.

What is claimed is:

1. A hanger assembly comprising:

a first decorative element having a first surface formed in a first plane and a first elongated mounting plate joined thereto in a second plane perpendicular to the first plane; and a mounting base having a rear surface fastenable to a vertical surface, a first sidewall, and a front surface within which is formed a recessed slot having a substantially T-shaped cross-section, said recessed slot extending from an open end in the first sidewall to a fixed stop formed in the mounting base and said recessed slot being operative to slidably accommodate the first elongated mounting plate;

wherein the mounting base further comprises a drain hole formed therein, the drain hole extending from the fixed stop to a second sidewall opposite the first sidewall.

2. The hanger assembly of claim 1, wherein the recessed slot is wider at the open end than at the fixed stop.

3. The hanger assembly of claim 1, further comprising a second decorative element having a second elongated mounting plate dimensioned as is the first elongated mounting plate, wherein the mounting base is operative to slidably release the first elongated mounting plate and to slidably accommodate the second mounting plate.

4. The hanger assembly of claim 1, wherein the first decorative element is operative to suspend a potted plant.

5. The hanger assembly of claim 1, wherein the mounting base further comprises fastener apertures formed therein, extending from the recessed slot to the rear surface.

6. A method of hanging a plant, comprising;

mounting the hanger assembly of claim 1 onto a vertical surface with the open end facing up;

inserting the first elongated mounting plate into the open end;

sliding the first elongated mounting plate to the fixed stop; and attaching the plant to the first decorative element.

7. The method of claim 6, further comprising:

removing the plant from the first decorative element;

sliding the first decorative element out of the recessed slot through the open end;

Inserting a second mounting plate of a second decorative element into the open end;

sliding the second mounting plate to the fixed stop; and attaching the plant to the second decorative element.

* * * * *